US008186292B2

(12) United States Patent
Yoo et al.

(10) Patent No.: US 8,186,292 B2
(45) Date of Patent: May 29, 2012

(54) LIQUEFIED NATURAL GAS STORAGE TANK FOR FLOATING MARINE STRUCTURE

(75) Inventors: Byeong Yong Yoo, Seoul (KR); Sung Kon Han, Seoul (KR); Young Il Park, Busan (KR); Sung Hoon Kim, Seoul (KR); Eun Seok Jin, Seoul (KR); Dae Hoon Kang, Seoul (KR)

(73) Assignee: Daewoo Shipbuilding & Marine Engineering Co., Ltd., Seoul (KR)

( * ) Notice: Subject to any disclaimer, the term of this patent is extended or adjusted under 35 U.S.C. 154(b) by 260 days.

(21) Appl. No.: 12/393,842

(22) Filed: Feb. 26, 2009

(65) Prior Publication Data

US 2009/0218354 A1 Sep. 3, 2009

(30) Foreign Application Priority Data

Feb. 26, 2008 (KR) ..... 10-2008-0017213

(51) Int. Cl.
*B63B 25/08* (2006.01)

(52) U.S. Cl. ..... 114/74 R; 114/74 T; 114/74 A

(58) Field of Classification Search ..... 114/74 R, 114/74 A, 74 T; 220/560.11, 562, 553; 62/53.2
See application file for complete search history.

(56) References Cited

U.S. PATENT DOCUMENTS

| | | | | | |
|---|---|---|---|---|---|
| 2,909,039 | A | * | 10/1959 | Richardson | 62/48.1 |
| 3,453,836 | A | * | 7/1969 | Kerr | 62/47.1 |
| 4,183,221 | A | * | 1/1980 | Yamamoto | 62/53.1 |
| 5,375,547 | A | | 12/1994 | Abe et al. | |
| 5,586,513 | A | | 12/1996 | Jean et al. | |
| 6,035,795 | A | | 3/2000 | Dhellemmes et al. | |
| 6,378,722 | B1 | | 4/2002 | Dhellemmes | |
| 2003/0000949 | A1 | | 1/2003 | Dhellemmes | |

FOREIGN PATENT DOCUMENTS

| | | | |
|---|---|---|---|
| KR | 10-1983-0000952 | B1 | 5/1983 |
| KR | 10-2000-0011346 | A | 2/2000 |
| KR | 10-0486122 | B1 | 2/2000 |
| KR | 10-0305513 | B1 | 7/2001 |
| KR | 1020070115240 | * | 5/2007 |

* cited by examiner

*Primary Examiner* — Edwin Swinehart

(74) *Attorney, Agent, or Firm* — Knobbe Martens Olson & Bear LLP

(57) ABSTRACT

Disclosed is a floating marine apparatus including a liquefied natural gas (LNG) tank. The apparatus includes a first LNG containing compartment and a second LNG containing compartment next to the first compartment. The apparatus further includes a bottom passage interconnecting bottom portions of the first and second compartments for fluid communication therebetween.

14 Claims, 4 Drawing Sheets

LIQUEFIED NATURAL GAS STORAGE TANK FOR FLOATING MARINE STRUCTURE

CROSS-REFERENCE TO RELATED APPLICATION

This application claims priority to and the benefit of Korean Patent Application No. 10-2008-0017213, filed Feb. 26, 2008, the disclosure of which is incorporated herein by reference in its entirety.

BACKGROUND

1. Field

The present disclosure relates to an apparatus with a liquefied natural gas (LNG) storage tank, and more particularly, to a ship with an LNG storage tank having a partitioning wall to divide the LNG tank into at least two compartments.

2. Discussion of the Related Technology

Natural gas which is in a gas state is transported through a gas pipe line installed on the land or in the sea, or natural gas which is in an LNG state is transported by an LNG transport vessel to distant markets while LNG is stored in the LNG vessel. LNG is produced by cooling natural gas at an extremely low temperature of approximately −163° C., and a volume of LNG is approximately 1/600 of a volume of natural gas which is in a gas state, so that marine transportation is suitable for a long-distance transportation of LNG.

The LNG transport vessel, which is employed for loading LNG, sailing on the sea and unloading LNG to land markets, comprises an LNG storage tank (generally referred to as a cargo containment) which can withstand extremely low temperature of LNG. The LNG storage tank installed in the LNG transport vessel may be classified into an independent type storage tank and a membrane type storage tank depending on whether a load of cargo is directly exerted on a heat-insulating material or not.

The configuration of a membrane type storage tank is disclosed in U.S. Pat. Nos. 6,035,795, 6,378,722, 5,586,513, U.S. Patent Application Publication No. 2003-0000849, and Korean Patent Laid-open Publication Nos. 10-2000-0011347 and 10-2000-0011346. In addition, the configuration of an independent type storage tank is disclosed in Korean Patent Nos. 10-15063 and 10-305513. The foregoing discussion in the background section is to provide general background information, and does not constitute an admission of prior art.

SUMMARY

One aspect of the invention provides a floating marine apparatus comprising a liquefied natural gas (LNG) tank, which comprises: a first LNG containing compartment; a second LNG containing compartment next to the first compartment; and a bottom passage interconnecting bottom portions of the first and second compartments for fluid communication therebetween.

In the foregoing apparatus, the apparatus may further comprise a partitioning wall partitioning the LNG tank into the first and second compartments. The partitioning wall may extend from the bottom to the top of the LNG tank. The bottom passage may be formed through the partitioning wall. The bottom passage may be always open for fluid communication between the first and second compartments. The bottom passage may be sized such that a worker can pass through the bottom passage.

Still in the foregoing apparatus, the apparatus may further comprise a top passage interconnecting top portions of the first and second compartments for fluid communication therebetween. The apparatus may further comprise a partitioning wall partitioning the LNG tank into the first and second compartments, wherein the top passage and the bottom passage are formed through the partitioning wall. The top passage may be always open for fluid communication between the first and second compartments.

Further in the foregoing apparatus, the apparatus may have only one pump that is dedicated to the LNG tank for pumping to discharge LNG from the LNG tank. The LNG tank may include only one discharge outlet for discharging a liquid phase LNG from the LNG tank. The bottom passage may be sized so as to a substantial amount of LNG to flow between the first and second compartments such that the levels of LNG contained the two compartments are substantially always equalized.

Another aspect of the invention provides a floating marine apparatus, which comprises: an LNG tank; a barrier wall formed within the LNG tank and partitioning a lower portion of the LNG tank into a first compartment and a second compartment, wherein a space within the LNG tank beyond the barrier wall is not partitioned; and a bottom passage interconnecting bottom portions of the first and second compartments for fluid communication therebetween.

In the foregoing apparatus, the barrier wall may have a height lower than about half the height of the LNG tank. The barrier wall may further partition a mid portion of the LNG tank, wherein the barrier wall has a height up to about 75% of the height of the LNG tank. The bottom passage may be formed through the barrier wall. The bottom passage may be always open for fluid communication between the first and second compartments. The apparatus may have only one pump that is dedicated to the LNG tank for pumping to discharge LNG from the LNG tank. The LNG tank may include only one discharge outlet for discharging a liquid phase LNG from the LNG tank. The bottom passage may be sized so as to a substantial amount of LNG to flow between the first and second compartments such that the levels of LNG contained the two compartments are substantially always equalized.

An aspect of the present invention provides an LNG storage tank in a floating marine structure, wherein a fluid passage is formed in a structure so that it is unnecessary to increase the number of equipments to be installed for discharging LNG loaded in the LNG storage tank although an internal space thereof is divided into a plurality of spaces by the structure.

Another aspect of the invention provides an LNG storage tank installed in a floating marine structure for storing LNG therein, which comprises a structure dividing an internal space of the LNG storage tank to reduce an influence of a sloshing phenomenon caused by the LNG; and a fluid passage formed through the reinforcing structure to allow the LNG to flow therethrough. The structure may be a cofferdam or partition extending from a bottom to a ceiling of the LNG storage tank to divide the internal space of the LNG storage tank into two subspaces.

At this time, the fluid passage preferably comprises an upper fluid passage formed in an upper portion of the cofferdam and allowing boil-off gas generated during transportation of the LNG to flow therethrough and a lower fluid passage formed in a lower portion of the cofferdam and allowing the LNG to flow therethrough.

Preferably, the upper fluid passage is formed in an uppermost end of the cofferdam adjacent to a ceiling of the LNG storage tank and the lower fluid passage is formed in a lowermost end of the cofferdam adjacent to a bottom of the LNG storage tank. The lower fluid passage may have a size allowing equipments and workers for maintenance of the LNG storage tank to pass through the lower fluid passage.

In addition, the structure may comprise a protruding wall formed to protrude on a bottom of the LNG storage tank by a certain height. Here, it is preferable that the fluid passage be a lower fluid passage formed in a lower portion of the protruding wall and allowing LNG to flow therethrough. Preferably, the lower fluid passage is formed in a lowermost end of the protruding wall adjacent to a bottom of the LNG storage tank.

The structure is preferably formed in the LNG storage tank in a lengthwise direction or in a widthwise direction. The fluid passage is preferably heat-insulated to prevent heat from being transferred from outside of the LNG storage tank. Preferably, the floating marine structure is one selected from an LNG floating, production, storage and offloading (FPSO), an LNG floating storage and re-gasification unit (FRSU), an LNG transport vessel and an LNG regasification vessel (LNG RV), each of which has a storage tank for storing liquid-phase material at an extremely low temperature and floats on the flowing sea.

A further aspect of the invention provides an LNG storage tank installed in a floating marine structure for storing LNG therein, comprising: a cofferdam dividing an internal space of the LNG storage tank to reduce an influence of a sloshing phenomenon caused by the LNG, wherein the cofferdam extends in lengthwise directions of the LNG storage tank.

DESCRIPTION OF EMBODIMENTS

Hereinafter, an LNG storage tank for storing LNG in a floating marine structure according to embodiments of the present invention will be described in more detail with reference to the accompanying drawings.

When an LNG storage tank is utilized on the sea, a sloshing phenomenon may be generated in an LNG storage tank. The sloshing phenomenon means that when a vessel plies on the sea under various sea conditions, liquid-phased material, i.e., LNG, accommodated in a storage tank is swayed. A great shock may be exerted on wall surfaces of the LNG storage tank by the sloshing.

Figure 1:
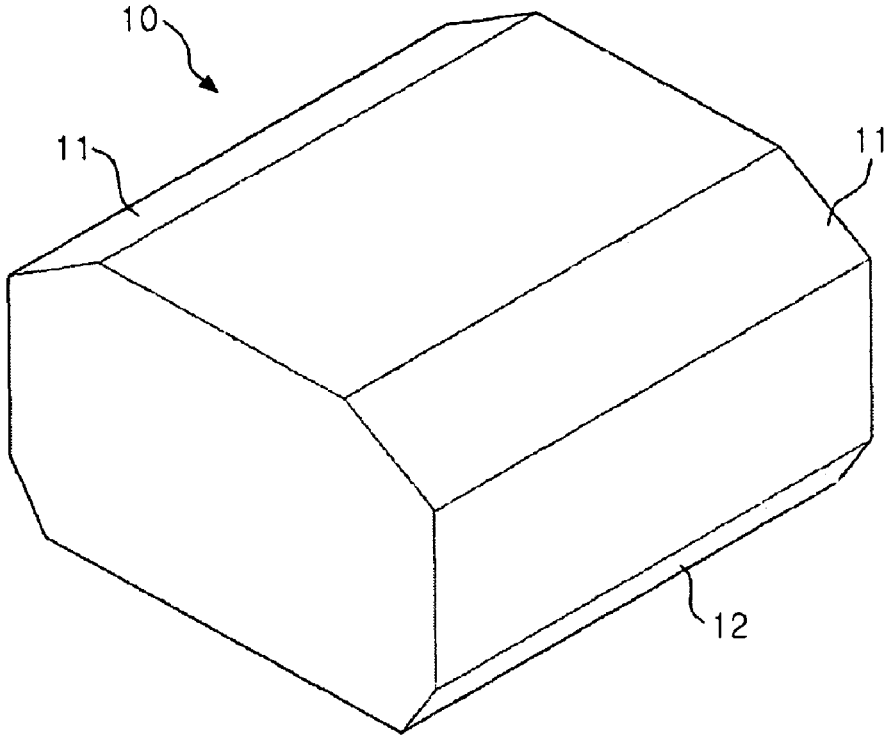
FIG. 1 is a perspective view showing an external appearance of an LNG storage tank.

FIG. 1 shows one example of an LNG storage tank 10, in which upper and lower chamfers 11 and 12, each of which is inclined at about 45 degrees, are formed on upper and lower portions of side surfaces of the LNG storage tank 10 in order to reduce sloshing load, in particular, lateral sloshing load, of LNG.

When LNG is partially loaded in the LNG storage tank as much as about 30 to 50% of an internal volume thereof, maximum sloshing load is exerted. Accordingly, in order to avoid such a partial loading state of the storage tank, an LNG transport vessel sails in a state where the LNG storage tank is fully filled with LNG or is completely empty by intention.

Demands for a floating marine structure such as an LNG floating, production, storage and offloading (LNG FPSO) or LNG floating storage and regasification unit (LNG FSRU) gradually increase. The LNG FPSO is the floating type maritime structure used for liquefying the produced natural gas directly on the sea, storing it in a storage tank, and delivering the LNG stored in the storage tank to an LNG transport vessel when necessary. In addition, the LNG FSRU is a floating type maritime structure, which stores LNG, which is unloaded from the LNG transport vessel, in a storage tank on the sea far away from the land and then gasifies the LNG, if necessary, and supplies the gasified natural gas to a market on the land.

Accordingly, unlike the LNG storage tank of an LNG transport vessel, in case of the LNG storage tanks provided in the floating marine structures, it would be difficult to adjust arbitrarily the amount of LNG to be stored, and thus the partial loading state of the storage tank causing the maximum sloshing load may not be avoided.

Figure 2:
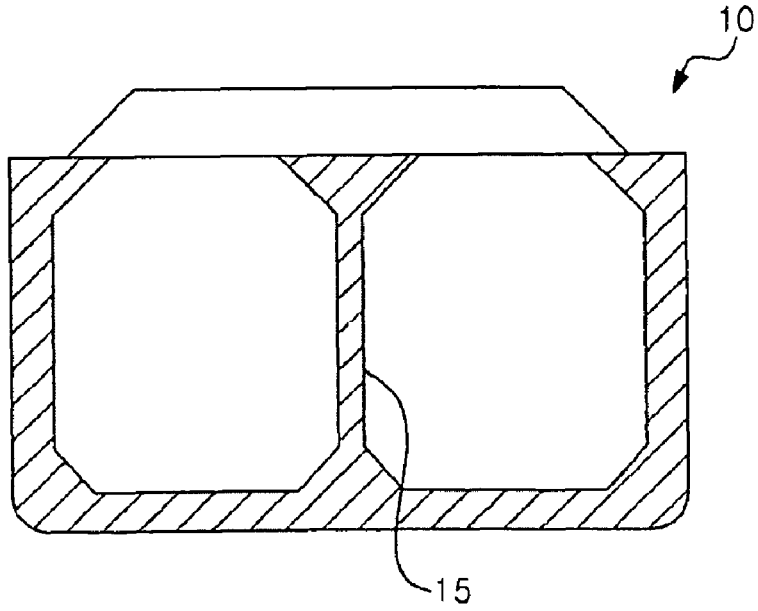
FIG. 2 is a transverse sectional view of an LNG storage tank.

FIG. 2 illustrates another potential method for reducing the sloshing load. As shown in FIG. 2, particularly in an LNG FPSO or LNG FRSU, in order to reduce an influence caused by the sloshing, it is considered that a cofferdam 15 is installed in the LNG storage tank 10 to divide the internal space of the LNG storage tank into a plurality of spaces.

However, in a case where the cofferdam 15 is installed in the LNG storage tank as described above, since the internal space of the LNG storage tank is divided into the independent spaces, pipe lines and equipments, such as pumps or pump towers for discharging LNG loaded in the LNG storage tank to the outside, would be installed separately in the respective independent spaces. Also, there are problems in that a manufacturing cost for the LNG storage tank is increased and the operation and management of the LNG storage tank become complicated.

A floating marine structure mentioned herein includes a structure and a vessel, each of which has a storage tank for storing liquid-phase material such as LNG at extremely low temperature and floats on the flowing sea. For example, the floating marine structure comprises a structure, such as an LNG floating, production, storage and offloading (LNG FPSO) or an LNG floating storage and regasification unit (LNG FSRU), as wells as a vessel, such as an LNG transport vessel or an LNG regasification vessel (LNG RV).

Figure 3:
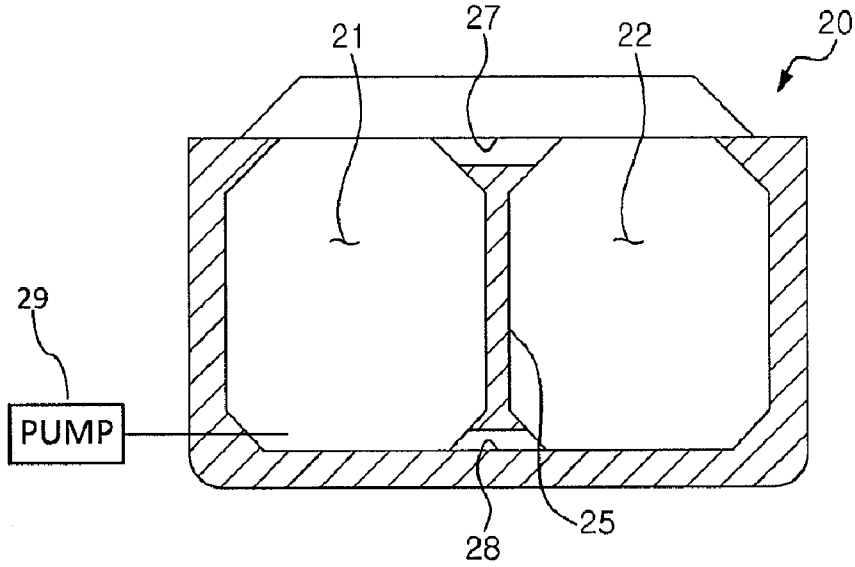
FIG. 3 is a transverse sectional view of an LNG storage tank for a floating marine structure according to one embodiment of the present invention.
Figure 4:
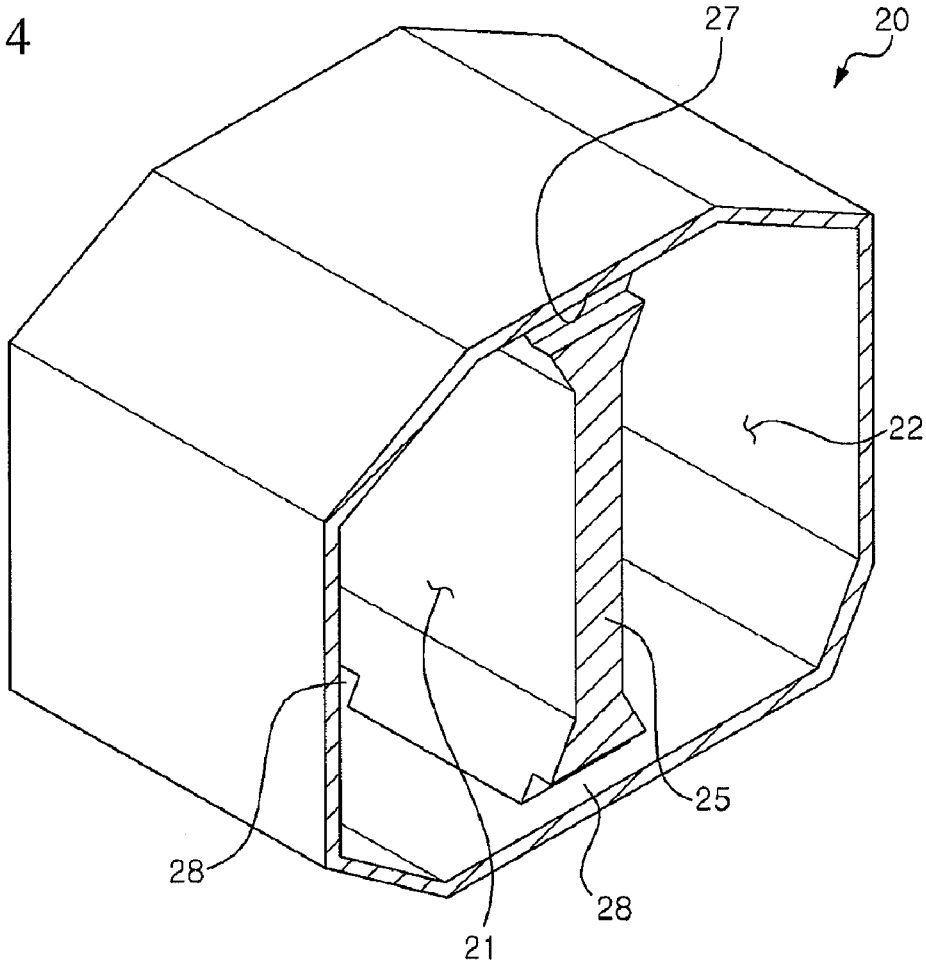
FIG. 4 is a partial sectional perspective view illustrating an interior of the LNG storage tank for a floating marine structure according to one embodiment of the present invention.

FIG. 3 is a transverse sectional view of an LNG storage tank for a floating marine structure according to one embodiment of the present invention, and FIG. 4 is a partial sectional perspective view illustrating an interior of the LNG storage tank for a floating marine structure. And, FIG. 5 is a partial sectional perspective view illustrating an interior of the LNG storage tank for a floating marine structure according to another embodiment.

Figure 5:
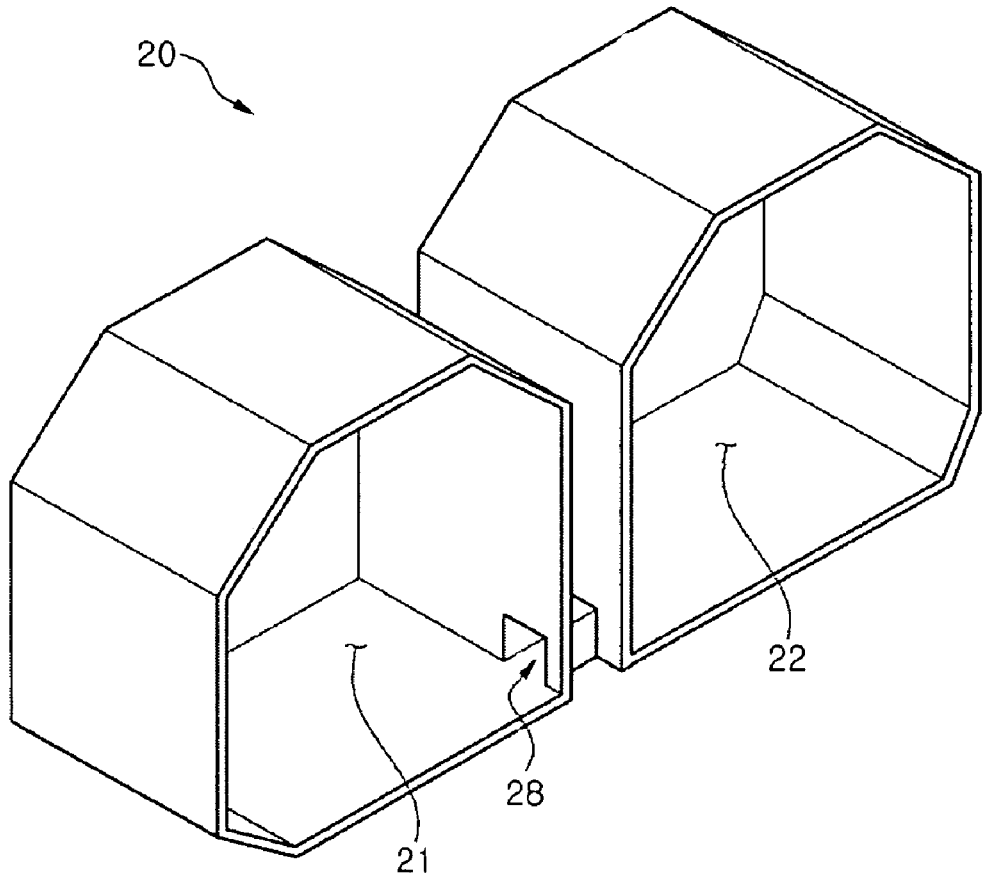
FIG. 5 is a partial sectional perspective view illustrating an interior of the LNG storage tank for a floating marine structure according to another embodiment.

As shown in FIGS. 3 to 5, an LNG storage tank 20 according to one embodiment of the present invention comprises a cofferdam 25 dividing an internal space thereof into a first space 21 and a second space 22 in order to reduce an influence caused by a sloshing phenomenon of LNG received therein.

Here, in a case where the LNG storage tank is a membrane type storage tank, the cofferdam is utilized as a structure which divides the internal space of the LNG storage tank into two spaces. Also, in a case where the LNG storage tank is an independent type storage tank, a partition may be utilized as a structure which divides the internal space of the storage tank into two spaces. Hereinafter, it will be described that the LNG storage tank is the membrane type storage tank and the cofferdam is employed as a structure for dividing the internal space into two spaces, but not limited thereto.

According to one embodiment, at least one upper fluid passage 27 and at least one lower fluid passage 28 are respectively formed through upper and lower portions of the cofferdam 25. The upper fluid passage 27 and the lower fluid passage 28 allow the first space 21 and the second space 22 in the LNG storage tank 20 to communicate with each other.

The upper fluid passage 27 is to enable boil-off gas (BOG) naturally generated during transportation of LNG to flow therethrough, and the lower fluid passage 28 is to enable LNG to flow therethrough.

According to one embodiment of the present invention, the upper fluid passage 27 enable BOG that is a gas phase to flow between the first space 21 and the second space 22 in the LNG storage tank 20 therethrough. Here, the upper fluid passage 27 is preferably formed at the uppermost end of the cofferdam 25, that is, at a portion adjacent to a ceiling of the LNG storage tank 20 in order to enable all the BOG in the LNG storage tank 20 to be discharged, even if the LNG storage tank 20 is provided with only one facility such as a gas dome (not shown) which can discharge the BOG to the outside according to internal pressure of the LNG storage tank 20 or other reason.

In addition, according to one embodiment of the present invention, the lower fluid passage 28 allows LNG that is a liquid phase to flow between the first space 21 and the second space 22 in the LNG storage tank 20 therethrough. Here, the lower fluid passage 28 is preferably formed at the lowermost end of the cofferdam 25, that is, at a portion adjacent to a bottom of the LNG storage tank 20 in order to enable all the LNG in the LNG storage tank 20 to be discharged, even if the LNG storage tank 20 is provided with only one facility such as a pump 29 and a pump tower (not shown) which can discharge the LNG stored in the LNG storage tank 20 to the outside. The number and the shape of the upper and lower fluid passages 27 and 28 may be modified appropriately according to a capacity of the LNG storage tank 20 and the like.

In addition, it is preferable that the upper fluid passage 27 and the lower fluid passage 28 be thermally insulated to prevent heat from being transferred from the outside of the LNG storage tank 20. Any heat-insulating technique applicable to the membrane type storage tank or the independent type storage tank can be utilized as the heat-insulating method.

Figure 6:
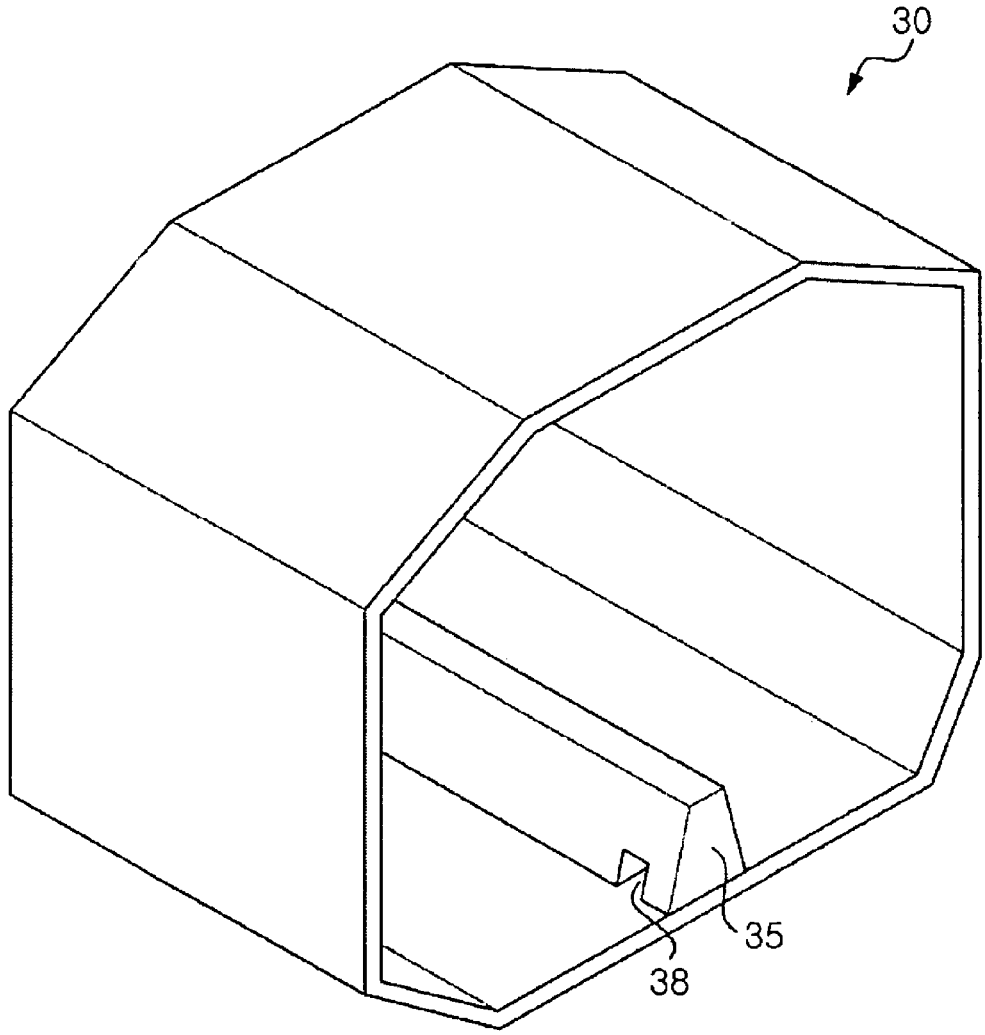
FIG. 6 is a partial sectional perspective view illustrating an interior of an LNG storage tank for a floating marine structure according to one embodiment of the present invention.

FIG. 6 is a partial sectional perspective view illustrating an interior of an LNG storage tank for a floating marine structure according to one embodiment of the present invention. As shown in FIG. 6, an LNG storage tank 30 according to one embodiment of the present invention comprises a protruding wall 35 having a certain height, which is formed to protrude on a bottom of the LNG storage tank, in order to reduce an influence caused by a sloshing phenomenon of LNG received therein.

As compared with one embodiment in which the cofferdam 25 is formed from the bottom to the ceiling of the LNG storage tank to completely divide the internal space of the LNG storage tank, the protruding wall 35 in one embodiment protrudes from a bottom of the LNG storage tank by a certain height so that a lower space of the LNG storage tank is divided, but an upper space thereof is not divided. The height of the protruding wall 35 is not limited only if an influence caused by the sloshing phenomenon can be effectively reduced.

In one embodiment, the ratio of the height of the protruding wall 35 with respect to that of the LNG tank is about 0.1 to about 0.8. In certain embodiments, the ratio is about 0.1, about 0.2, about 0.3, about 0.35, about 0.4, about 0.45, about 0.5, about 0.55, about 0.6, about 0.65, about 0.7, about 0.75, about 0.8 or about 0.9. In some embodiments, the ratio may be within a range defined by two of the foregoing ratio.

According to one embodiment, at least one lower fluid passage 38 is formed through a lower portion of the protruding wall 35. The lower fluid passage 38 is to allow LNG to flow therethrough.

In the LNG storage tank 30, the lower fluid passage 38 formed in the protruding wall 35 allows liquid-phased LNG to flow therethrough. The lower fluid passage 38 is preferably formed at a lowermost end of the protruding wall 35, that is, at a portion adjacent to a bottom of the LNG storage tank 30 so that all the LNG in the LNG storage tank 30 can be discharged even if the LNG storage tank 30 is provided with only one facility such as a pump (not shown) and a pump tower (not shown) which can discharge the LNG stored in the LNG storage tank 30 to the outside.

The number and the shape of the lower fluid passage 38 may be appropriately modified considering the size of the LNG storage tank 30 and the like.

In addition, it is preferable that the lower fluid passage 38 be thermally insulated to prevent heat from being transferred from the outside of the LNG storage tank 30. Any heat-insulating technique applicable to the membrane type storage tank or the independent type storage tank can be utilized as the heat-insulating method.

In one embodiment, the protruding wall 35 may be a structure such as a partition installed merely in the LNG storage tank, or a structure obtained by modifying an external appearance of the LNG storage tank and thus changing the shape of the LNG storage tank itself.

As the storage tank in which the structure such as the aforementioned cofferdam 25 (partition in case of the independent type storage tank) or the protruding wall 35 is formed, any kind of storage tank including the independent type storage tank and the membrane type storage tank may be employed, if the storage tank can store LNG.

The structure such as the cofferdam 25 or protruding wall 35 installed in the LNG storage tank may have a cross shape as viewed from top. That is, the structure may extend in lengthwise and widthwise directions of the LNG storage tank 20 or 30. Also, the structure may be formed to extend in only a lengthwise or widthwise direction of the LNG storage tank 20 or 30.

The number and the size of the lower fluid passage 28 or 38 may be modified if the lower fluid passage 28 or 38 allows the LNG to flow therethrough in the LNG storage tank 20 or 30. Also, the lower fluid passage 28 or 38 may have the size that equipments and workers for maintenance of the LNG storage tank 20 or 30 can pass through the lower fluid passage 28 or 38.

According to embodiments of the present invention as described above, the structure such as the cofferdam, the partition or the protruding wall for restraining the sloshing phenomenon from occurring is provided in the LNG storage tank, so that although the internal space of the LNG storage tank is divided into a plurality of spaces, the LNG storage tank can be operated smoothly by installing one equipment such as a pump, a pump tower and a gas dome utilized for discharging the LNG and boil-off gas loaded in the LNG tank storage. As a result, it is possible to save the manufacturing cost of the LNG storage tank and operate and manage the LNG storage tank easily.

According to embodiments of the present invention as described above, there can be provided an LNG storage tank in a floating marine structure, wherein a fluid passage is formed in a partition structure so that it is unnecessary to increase the number of equipments to be installed for discharging LNG loaded in the LNG storage tank although an internal space thereof is divided into a plurality of spaces by the partition structure installed for enhancing the strength of the LNG storage tank.

Therefore, according to embodiments of the present invention, it is possible to save the manufacturing cost of the LNG storage tank and operate and manage easily the LNG storage tank.

Although a structure of a storage tank for the floating marine structure according to embodiments of the present invention has been described with reference to the drawing, the present invention is not limited to embodiments and drawing illustrated above. It will be apparent that those skilled in the art can make various modifications and changes thereto within the scope of the invention defined by the claims.

What is claimed is:

1. A floating marine apparatus comprises:

a marine structure floating on water; and a liquefied natural gas (LNG) tank installed on the marine structure, the LNG tank comprising:

a top wall, a bottom wall, a first LNG containing compartment, a second LNG containing compartment next to the first compartment, and a partitioning wall partitioning between the first and second compartments, the partitioning wall comprising a top section connected to the top wall, a bottom section, and an intermediate section interposed between the top and bottom sections, the bottom section comprising a lower portion connected to the bottom wall and a upper portion connected to the intermediate section, wherein the bottom section becomes generally gradually thicker from the upper portion to the bottom wall such that the lower portion connected to the bottom wall is thicker than the upper portion connected to the intermediate section, the bottom section further comprises a passage through a thicker lower portion for fluid communication between the first and second compartments.

2. The apparatus of claim 1, wherein the passage is formed through the bottom portion of the partitioning wall.

3. The apparatus of claim 1, wherein the passage is always open for fluid communication between the first and second compartments.

4. The apparatus of claim 1, wherein the passage is sized such that a worker can pass through the bottom passage.

5. The apparatus of claim 1, further comprising a top passage interconnecting top portions of the first and second compartments for fluid communication therebetween.

6. The apparatus of claim 5, wherein the top passage is formed through the top section of the partitioning wall.

7. The apparatus of claim 5, wherein the top passage is always open for fluid communication between the first and second compartments.

8. The apparatus of claim 1, wherein the apparatus has only one pump that is dedicated to the LNG tank for pumping to discharge LNG from the LNG tank.

9. The apparatus of claim 1, wherein the LNG tank includes only one discharge outlet for discharging a liquid phase LNG from the LNG tank.

10. The apparatus of claim 1, wherein the passage is sized so as to a substantial amount of LNG to flow between the first and second compartments such that the levels of LNG contained the two compartments are substantially always equalized.

11. The apparatus of claim 1, wherein the partitioning wall comprises a cofferdam.

12. The apparatus of claim 1, wherein the marine structure is one selected from the group consisting of an LNG carrier, an LNG Regasification Vessel (LNG RV), an LNG Floating Production Storage and Offloading (LNG FPSO) and an LNG Floating Storage and Regasification Unit (LNG FSRU).

13. The apparatus of claim 1, wherein the top section comprises a upper portion connected to the top wall and a lower portion connected to the intermediate section, wherein the top section becomes generally gradually thicker from the lower portion to the top wall such that the upper portion connected to the top wall is thicker than lower portion connected to the intermediate section.

14. The apparatus of claim 13, wherein the top section further comprises a passage through the thicker upper portion, which allows fluid communication between the first and second compartments.

* * * * *